US009768588B2

(12) United States Patent
Kikai et al.

(10) Patent No.: US 9,768,588 B2
(45) Date of Patent: Sep. 19, 2017

(54) SPARK PLUG AND MANUFACTURING METHOD THEREFOR

(75) Inventors: Takaaki Kikai, Ama (JP); Tomoo Tanaka, Kitanagoya (JP); Tsutomu Shibata, Owariasahi (JP); Kaori Suzuki, Obu (JP); Takehito Kuno, Nagoya (JP)

(73) Assignee: NGK Spark Plug Co., Ltd. (JP)

( * ) Notice: Subject to any disclaimer, the term of this patent is extended or adjusted under 35 U.S.C. 154(b) by 194 days.

(21) Appl. No.: 13/877,352

(22) PCT Filed: Oct. 6, 2011

(86) PCT No.: PCT/JP2011/073064
§ 371 (c)(1),
(2), (4) Date: Apr. 2, 2013

(87) PCT Pub. No.: WO2012/086292
PCT Pub. Date: Jun. 28, 2012

(65) Prior Publication Data

US 2013/0200774 A1 Aug. 8, 2013

(30) Foreign Application Priority Data

Dec. 20, 2010 (JP) ..... 2010-282507

(51) Int. Cl.
*H01T 13/39* (2006.01)
*H01T 13/32* (2006.01)
*H01T 21/02* (2006.01)

(52) U.S. Cl.
CPC ..... *H01T 13/39* (2013.01); *H01T 13/32* (2013.01); *H01T 21/02* (2013.01)

(58) Field of Classification Search
CPC ..... H01T 13/32; H01T 13/39
(Continued)

(56) References Cited

U.S. PATENT DOCUMENTS 4,581,558 A * 4/1986 Takamura et al. ..... 313/141
6,603,244 B2 8/2003 Sugiyama et al. ..... 313/118
(Continued)

FOREIGN PATENT DOCUMENTS

CN 101340064 A 1/2009 ..... H01T 13/39
CN 101911409 A 12/2010 ..... H01T 13/16
(Continued)

OTHER PUBLICATIONS

Form PCT/ISA/210—Int'l Search Report (from corresponding Int'l Patent App. No. PCT/JP2011/073064)—2 pages.
(Continued)

*Primary Examiner* — Joseph L Williams
*Assistant Examiner* — Christopher Raabe
(74) *Attorney, Agent, or Firm* — Kusner & Jaffe

(57) ABSTRACT

A spark plug includes a ceramic insulator having an axial hole formed in an axis direction of the spark plug, a center electrode inserted in a front side of the axial hole, a metal shell disposed around the ceramic insulator and a ground electrode joined to a front end portion of the metal shell, wherein the ground electrode has a cross-sectional area of 2.0 $mm^2$ or smaller in any arbitrary cross section thereof taken in a direction perpendicular to a center line of the ground electrode; the ground electrode is made of a metal material containing 93 mass % or more of nickel; and the ground electrode has a Vickers hardness of 130 to 260 Hv.

8 Claims, 5 Drawing Sheets

(58) Field of Classification Search
USPC ..... 313/118–145
See application file for complete search history.

(56) References Cited

U.S. PATENT DOCUMENTS

| | | | | |
|---|---|---|---|---|
| 6,794,803 | B2 | 9/2004 | Hori et al. | 313/141 |
| 7,893,604 | B2 | 2/2011 | Takeuchi et al. | 313/143 |
| 8,102,105 | B2 | 1/2012 | Ban et al. | 313/141 |
| 8,164,242 | B2 | 4/2012 | Yoshimoto et al. | 313/141 |
| 8,640,666 | B2 | 2/2014 | Kameda et al. | 123/169 EL |
| 2002/0158559 | A1* | 10/2002 | Sugiyama et al. | 313/141 |
| 2003/0038575 | A1* | 2/2003 | Hori et al. | 313/141 |
| 2009/0009048 | A1 | 1/2009 | Yoshimoto et al. | 313/142 |
| 2010/0096968 | A1 | 4/2010 | Ban et al. | 313/141 |
| 2010/0133977 | A1 | 6/2010 | Kato | 313/141 |
| 2010/0275870 | A1 | 11/2010 | Kameda et al. | 123/169 EL |
| 2011/0095672 | A1 | 4/2011 | Ban et al. | 313/142 |

FOREIGN PATENT DOCUMENTS

| | | | | |
|---|---|---|---|---|
| EP | 1 237 244 | A2 | 4/2002 | H01T 13/39 |
| EP | 1 241 754 | A2 | 9/2002 | H01T 13/39 |
| EP | 2 161 802 | A2 | 10/2010 | H01T 13/32 |
| JP | 10-251786 | | 9/1998 | C22C 19/05 |
| JP | 2002-260818 | | 9/2002 | C22C 19/03 |
| JP | 2003-229231 | | 8/2003 | H01T 21/02 |
| JP | 2008-108478 | | 5/2008 | H01T 13/02 |
| JP | 2009-094047 | | 4/2009 | H01T 13/20 |
| JP | 2010-049911 | | 3/2010 | H01T 21/02 |
| WO | WO2009/020141 | | 2/2009 | H01T 13/20 |
| WO | WO2010/026940 | | 3/2010 | H01T 13/20 |

OTHER PUBLICATIONS

Office Action received in corresponding Chinese Patent Application No. 201180061371.5, dated Jun. 9, 2014 (Concise Explanation of Relevance included).

Office Action received in corresponding Chinese Patent Application No. 201180061371.5, dated Jan. 13, 2015.

Supplementary European Search Report from corresponding European Patent Application No. 11851707.7 dated Nov. 28, 2014.

* cited by examiner

SPARK PLUG AND MANUFACTURING METHOD THEREFOR

FIELD OF THE INVENTION

The present invention relates to a spark plug for an internal combustion engine or the like and a method for manufacturing the spark plug.

BACKGROUND OF THE INVENTION

A spark plug is mounted to an internal combustion engine (sometimes just referred to as "engine") and used for ignition of an air-fuel mixture in a combustion chamber of the engine. In general, the spark plug includes an insulator formed with an axial hole, a center electrode inserted in a front side of the axial hole, a metal shell arranged circumferentially around the insulator and a ground electrode joined to a front end portion of the metal shell. The ground electrode has a bent portion formed at a substantially middle position thereof in such a manner that a distal end portion of the ground electrode faces a front end portion of the center electrode so as to define a spark discharge gap between the distal end portion of the ground electrode and the front end portion of the center electrode. With the application of a high voltage to the center electrode, a spark discharge occurs in the spark discharge gap to ignite the air-fuel mixture (see, for example, Japanese Laid-Open Patent Publication No. 2008-108478). For improvement in corrosion resistance, the metal shell joined with the ground electrode may be coated with a Ni plating layer or zinc plating layer by a barrel plating machine etc.

There has recently been a demand to reduce the thickness of the ground electrode so that the ground electrode can be joined to the diameter-reduced metal shell for the purpose of size and diameter reduction of the spark plug. However, such a thin ground electrode may be bent or twisted during the process of applying the Ni plating layer to the ground electrode or the process of joining the ground electrode to the metal shell. Further, it is unlikely in the relatively thin ground electrode that heat will be transferred from the distal end portion of the ground electrode to the metal shell. This can result in quick wearing of the distal end portion of the ground electrode during use.

The present invention has been made in view of the above circumstances. An advantage of the present invention is a spark plug having a relatively thin ground electrode configured to obtain improvements in both of deformation resistance and wear resistance. Another advantage of the present invention is a method for manufacturing such a spark plug.

SUMMARY OF THE INVENTION

Hereinafter, configurations suitable for achieving the advantage of the present invention will be described below. Specific functions and effects of the respective aspects will also be described below as needed.

Aspect 1

A spark plug, comprising a cylindrical insulator having an axial hole formed therethrough in an axis direction of the spark plug; a center electrode inserted in a front side of the axial hole; a cylindrical metal shell disposed around the insulator; and a ground electrode joined to a front end portion of the metal shell in such a manner as to define a gap between the center electrode and the ground electrode, wherein the ground electrode is made of a metal material containing 93 mass % or more of nickel; wherein the ground electrode has a cross-sectional area of 2.0 $mm^2$ or smaller in any arbitrary cross section thereof taken in a direction perpendicular to a center line of the ground electrode; and wherein the ground electrode has a hardness of 130 to 260 Hv in terms of Vickers hardness.

According to aspect 1, the cross-sectional area of the ground electrode is controlled to 2.0 $mm^2$ or smaller so that the ground electrode is made very small in thickness. There is thus a possibility that the ground electrode may deteriorate in deformation resistance and wear resistance.

In view of this possibility, the hardness of the ground electrode is controlled to 130 Hv or higher, according to aspect 1, so as to provide sufficient mechanical strength to the ground electrode. It is therefore possible to secure the sufficient deformation resistance of the ground electrode.

The hardness of the ground electrode is also controlled to 260 Hv or lower, according to aspect 1, so as to prevent distortion of metal crystal grains in the ground electrode. This allows smooth conduction of heat inside the ground electrode for improvement of the thermal conductivity of the ground electrode. Further, the ground electrode is made of the metal material containing 93 mass % or more of high thermal conductivity Ni so as to obtain further improvement in the thermal conductivity of the ground electrode. In other words, the thermal conductivity of the ground electrode can be increased dramatically by making the ground electrode of the metal material containing 93 mass % or more of Ni while controlling the hardness of the ground electrode to 260 Hv or lower. It is therefore possible to attain the high wear resistance of the ground electrode even in the case where the ground electrode is formed with a cross-sectional area of 2.0 $mm^2$ or smaller and particularly concerned about deterioration in wear resistance.

Aspect 2

The spark plug according to aspect 1, wherein the ground electrode has a hardness of 150 to 240 Hv in terms of Vickers hardness.

According to aspect 2, the hardness of the ground electrode is controlled to 150 Hv or higher so as to obtain further improvement in the mechanical strength of the ground electrode. It is therefore possible to improve the deformation resistance of the ground electrode to a higher level.

The hardness of the ground electrode is also controlled to 240 Hv or lower, according to aspect 2, so as to more effectively prevent distortion of metal crystal grains in the ground electrode and obtain further improvement in the thermal conductivity of the ground electrode. It is therefore possible to improve the wear resistance of the ground electrode to a higher level.

Aspect 3

The spark plug according to aspect 1 or 2, wherein the ground electrode has a ratio L/S (1/mm) of 3 to 10, where S is a maximum cross-sectional area of the cross section of the ground electrode taken perpendicular to the center line of the ground electrode and L is a length of the ground electrode along the center line of the ground electrode.

According to aspect 3, the ratio L/S is controlled to 10 (1/mm) or smaller so that the length L does not become excessively large. This allows reduction of stress on the ground electrode during plating process etc. It is therefore possible to improve the deformation resistance of the ground electrode to a higher level.

There is a problem that the distal end portion of the ground electrode may not be brought sufficiently close to the center electrode, thereby failing to define the gap (spark discharge gap) between the distal end portion of the ground electrode and the center electrode, if the ratio L/S is excessively small. However, such a problem can be eliminated as the ratio L/S is controlled to 3 (1/m) or larger according to aspect 3.

Aspect 4

The spark plug according to any one of aspects 1 to 3, wherein the ground electrode has a flat surface facing the center electrode and a convex curved back surface located opposite the flat surface.

According to aspect 4, the back surface of the ground electrode is formed into a convex curved shape. This allows fuel gas to easily flow into the gap along the ground electrode. It is therefore possible to improve the ignition performance of the spark plug.

On the other hand, the ground electrode with such a curved surface may have, on an outer circumference thereof, no edge or edges of relatively large angle in contrast to a rectangular cross-section ground electrode. This can result in deterioration of the mechanical strength of the ground electrode. It is however possible by the adoption of aspect 1 etc. to sufficiently maintain the mechanical strength of the ground electrode and assuredly prevent the ground electrode from bending deformation or the like. Namely, the adoption of aspect 1 etc. is particularly effective for the spark plug in which the back surface of the ground electrode is convex curved.

Aspect 5

The ground electrode according to any one of aspects 1 to 4, wherein the ground electrode has a flat surface facing the center electrode, a flat back surface located opposite the flat surface and opposite, convex curved side surfaces extending between the flat surface and back surface of the ground electrode.

According to aspect 5, the opposite side surfaces of the ground electrode are formed into a convex curved shape. This allows the fuel gas to more easily flow into the gap. It is therefore possible to improve the ignition performance of the spark plug to a higher level.

There is a possibility that the ground electrode may deteriorate in mechanical strength due to the formation of the curved surface on the ground electrode. It is however possible by the adoption of aspect 1 etc. to sufficiently maintain the mechanical strength of the ground electrode and assuredly prevent the ground electrode from bending deformation or the like.

Aspect 6

The spark plug according to any one of aspects 1 to 5, wherein the ground electrode has a ratio T/W of 0.6 or larger, where T (mm) is a thickness of the ground electrode and W (mm) is a width of the ground electrode.

As mentioned above, there may occur a bend or the like in the ground electrode during plating process etc. It is particularly likely that the ground electrode will be bent in a thickness direction thereof.

In view of this point, the thickness T of the ground electrode is made 0.6 times or larger than the width W of the ground electrode, according to aspect 6, so that the thickness T does not become excessively small. This allows the ground electrode to attain sufficient strength against load in the thickness direction. It is therefore possible to more assuredly prevent the ground electrode from bending.

If the thickness T of the ground electrode is excessively large relative to the width W of the ground electrode, there is a need to increase the thickness of the metal shell to which the ground electrode is joined. However, the metal shell gets closer to the insulator as the thickness of the metal shell becomes increased. This can result in a problem that a spark discharge is likely to occur between the center electrode and the metal shell. It is thus preferable to control the ratio T/W to 1.0 or smaller in order to avoid such a problem.

Aspect 7

The spark plug according to any one of claims 1 to 6, wherein the metal material of the ground electrode contains one or more kinds of rare earth elements in a total amount of 0.05 to 0.45 mass %.

In general, it is likely that grain growth will occur in the metal material under high-temperature conditions when the metal material contains a large amount of Ni. There is thus a possibility about the grain growth of the metal material of the ground electrode in the case where the metal material of the ground electrode has a high Ni content as in aspect 1.

According to aspect 7, one or more kinds of rare earth elements are added into the ground electrode in a total amount of 0.05 mass % or more. It is therefore possible to improve the wear resistance of the ground electrode to a higher level by preventing the growth of metal grains in the ground electrode more assuredly. As the grain growth can be prevented, it is possible to assuredly protect the ground electrode from breakage even in the case where the ground electrode is subjected to vibrations under high-temperature conditions.

On the other hand, a so-called grain sweating phenomenon is likely to occur on the surface of the ground electrode if the total amount of the rare earth elements is excessively large. In the occurrence of such a grain sweating phenomenon, the gap between the center electrode and the ground electrode is locally narrowed. This can result in deterioration of the ignition performance of the spark plug. In view of this point, the total amount of the rare earth elements is controlled to 0.45 mass % or less according to aspect 7. It is therefore possible to assuredly prevent deterioration in the ignition performance of the spark plug by effectively avoiding the grain sweating phenomenon.

Aspect 8

The spark plug according to any one of claims 1 to 7, wherein the at least part of a surface of the ground electrode is covered with a plating layer.

According to aspect 8, the plating layer is applied to at least part of the surface of the ground electrode. It is therefore possible to improve the corrosion resistance of the ground electrode.

If the cross-sectional area of the ground electrode is 2.0 $mm^2$ or smaller, it is likely that the ground electrode will be bent or twisted under the load of the plating process. It is however possible to effectively prevent the ground electrode from bending deformation or the like by the adoption of aspect 1 etc. Namely, the adoption of aspect 1 etc. is particularly effective for the spark plug in which the plating layer is applied to the surface of the ground electrode (that is, the ground electrode is subjected to plating process).

Aspect 9

A method for manufacturing the spark plug according to any one of aspects 1 to 8, comprising a metal member forming step of forming a ground-electrode metal member for the production of the ground electrode, wherein the metal member forming step includes a softening step of heat treating a semi-processed member of metal material containing 93 mass % or more of Ni so as to decrease the hardness of the semi-processed member; and a hardening step of, after the softening step, subjecting the semi-processed member to plastic working so as to increase the hardness of the semi-processed member and thereby complete the semi-processed member as the ground-electrode metal member.

As a technique to control the hardness of a metal material to a predetermined level, it is conceivable to decrease the hardness of the metal material to the predetermined level by heat treatment of the metal material. In the technique of hardness control by heat treatment, however, there is a possibility that the hardness of the metal material may become lower than the predetermined level or may not be decreased to the predetermined level in the occurrence of only a slight variation in the heating temperature or heating time during the heat treatment. The metal material of predetermined hardness cannot be obtained easily as there is a need to very carefully manage the temperature conditions etc. in the technique of hardness control by heat treatment.

In view of this point, the ground-electrode metal material is formed by softening the semi-processed member by heat treatment, and then, hardening the semi-processed member by plastic working according to aspect 9. In other words, the hardness of the semi-processed member is increased and controlled to the predetermined level by plastic working. The plastic working enables easy control of the hardness of the metal member by adjusting the working rate of the metal material. It is therefore possible to easily obtain the ground-electrode metal member of predetermined hardness for improvement in productivity.

BRIEF DESCRIPTION OF THE DRAWINGS

FIG. 4(*b*) is a section-view of a ground-electrode metal member.

DETAILED DESCRIPTION OF PREFERRED EMBODIMENTS

Figure 1:
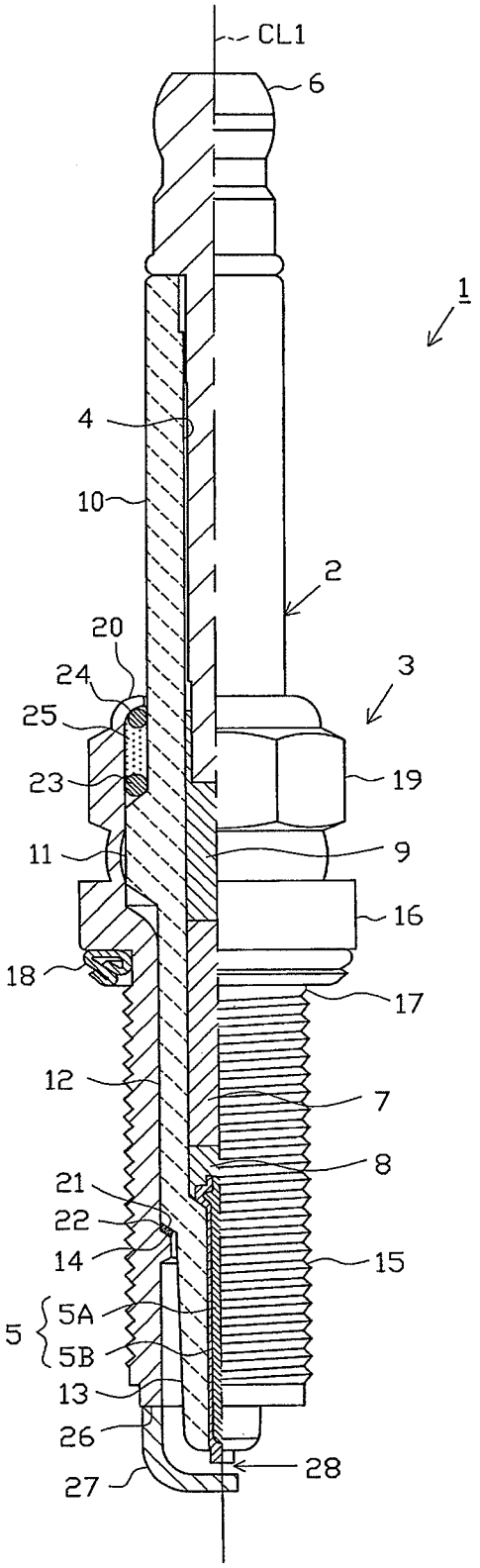
FIG. 1 is a partially cutaway, front view of a spark plug according to one embodiment of the present invention.
Figure 2:
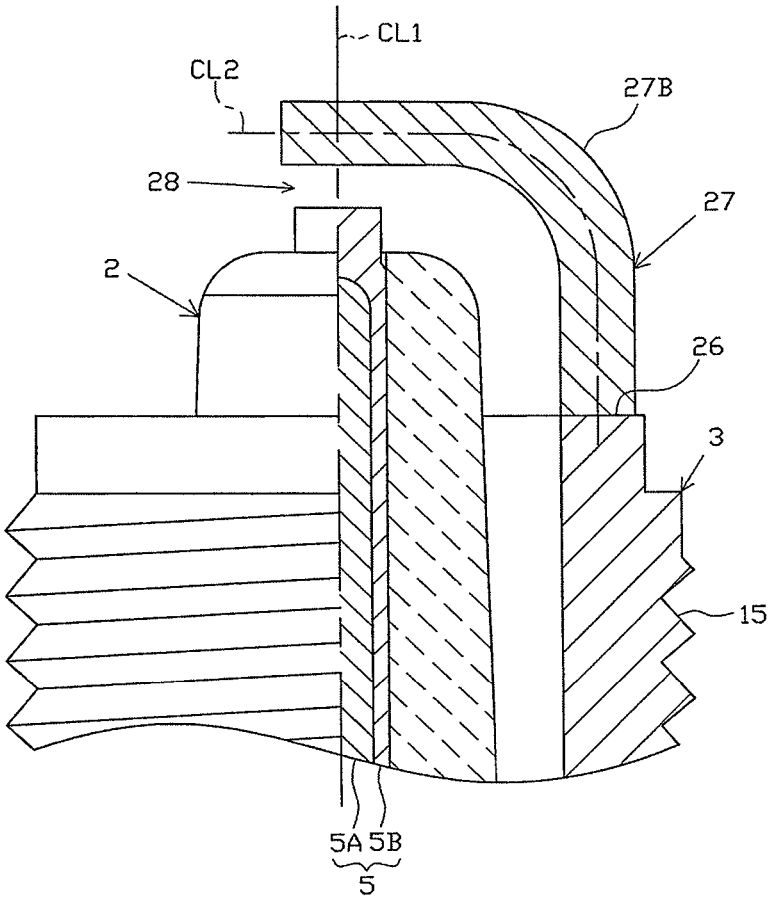
FIG. 2 is a partially cutaway, enlarged front view of a front end part of the spark plug.

Hereinafter, one embodiment of the present invention will be described below with reference to the drawings. FIG. 1 is a partially cutaway, front view of a spark plug 1 according to one embodiment of the present invention. It is herein noted that, in the following explanation, the bottom and top sides in FIG. 1 are referred to as front and rear sides with respect to the direction of an axis CL1 of the spark plug 1, respectively.

The spark plug 1 includes a ceramic insulator 2 as a cylindrical insulator and a cylindrical metal shell 3 retaining therein the ceramic insulator 2.

As is generally known, the ceramic insulator 2 is formed by sintering alumina etc. The ceramic insulator 2 has an outer shape including a rear body portion 10 located on a rear side thereof, a large-diameter portion 11 located front of the rear body portion 10 and protruding radially outwardly, a middle body portion 12 located front of the large-diameter portion 11 and made smaller in diameter than the large-diameter portion 11 and a leg portion 13 located front of the middle body portion 12 and made smaller in diameter than the middle body portion 12. The large-diameter portion 11, the middle body portion 12 and a major part of the leg portion 13 of the ceramic insulator 2 are accommodated in the metal shell 3. The ceramic insulator 2 also has a tapered step portion 14 formed at a position between the middle body portion 12 and the leg portion 13 such that the ceramic insulator 2 is retained in the metal shell 3 by means of the step portion 14.

An axial hole 4 is formed through the ceramic insulator 2 in the direction of the axis CL1. A center electrode 5 is inserted and fixed in a front side of the axial hole 4. Herein, the center electrode 5 has an inner layer 5A made of copper or a copper alloy and an outer layer 5B made of a Ni alloy containing nickel (Ni) as a main component. Further, the center electrode 5 is formed, as a whole, into a rod shape (cylindrical column shape) and arranged in such a manner that a front end portion of the center electrode 5 protrudes from a front end of the ceramic insulator 2.

A terminal electrode 6 is inserted and fixed in a rear side of the axial hole 4 with a rear end portion of the terminal electrode 6 protruding from a rear end of the ceramic insulator 2.

A cylindrical column-shaped resistive element 7 is disposed between the center electrode 5 and the terminal electrode 6 within the axial hole 4 and is electrically connected at opposite ends thereof to the center electrode 5 and the terminal electrode 6 through conductive glass seal layers 8 and 9, respectively.

The metal shell 3 is made of a metal material such as low carbon steel and formed into a cylindrical shape. The metal shell 3 has, on an outer circumferential surface thereof, a thread portion (male thread portion) 15 formed for mounting the spark plug 1 onto a combustion apparatus such as an internal combustion engine, a fuel cell processing device or the like and a seat portion 16 formed rear of the thread portion 15. A ring-shaped gasket 18 is fitted around a thread neck 17 on a rear end of the thread portion 15. The metal shell 3 also has, on a rear end side thereof, a tool engagement portion 19 formed into a hexagonal cross section so as to engage with a tool such as wrench for mounting the spark plug 1 onto the combustion apparatus and a crimped portion 20 bent radially inwardly. In the present embodiment, the diameter of the metal shell 3 is reduced to a level that the thread portion 15 has a relatively small thread diameter size (e.g. M12 or smaller) for downsizing of the spark plug 1.

The metal shell 3 has, on an inner circumferential thereof, a tapered step portion 21 adapted to retain thereon the ceramic insulator 2. The ceramic insulator 2 is inserted in the metal shell 3 from the rear toward the front and fixed in the metal shell 3 by crimping an open rear end of the metal shell 3 radially inwardly, with the step portion 14 of the ceramic insulator 2 retained on the step portion 21 of the metal shell 3, and thereby forming the crimped portion 20. An annular plate packing 22 is held between the step portion 14 of the ceramic insulator 2 and the step portion 21 of the metal shell 3 so as to maintain the gas-tightness of the combustion chamber and prevent fuel gas from leaking to the outside through a space between the inner circumferential surface of the metal shell 3 and the leg portion 13 of the ceramic insulator 2 exposed to the combustion chamber.

In order to secure more complete seal by crimping, annular ring members 23 and 24 are disposed between the metal shell 3 and the ceramic insulator 2 within the rear end portion of the metal shell 3; and a powder of talc 25 is filled in between the ring members 23 and 34. Namely, the metal shell 3 retains therein the ceramic insulator 2 via the plate packing 22, the ring members 23 and 24 and the talc 25.

The spark plug 1 further includes a ground electrode 27 of rectangular cross section joined to a front end face 26 of the metal shell 3 and bent at a bent portion 27B thereof in such a manner that a distal end portion of the ground electrode 27 has a flat lateral surface facing the front end portion of the center electrode 5. There is thus defined a spark discharge gap 28, as a gap, between the front end portion of the center electrode 5 and the distal end portion of the ground electrode 27 so that a spark discharge occurs substantially along the direction of the axis CL1 within the spark discharge gap 28.

In the present embodiment, the ground electrode 27 is made of a metal material containing 93 mass % or more of Ni. Further, the metal material of the ground electrode 27 contains one or more kinds of rare earth elements in a total amount of 0.05 to 0.45 mass %. Specific examples of the rare earth elements are: lanthanoids such as yttrium (Y), lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb) and lutetium (Lu); and scandium (Sc).

The ground electrode 27 also contains a predetermined amount (e.g. 0.15 to 2.5 mass %) of silicon (Si) and a predetermined amount (e.g. 0.05 to 2.5 mass %) of manganese (Mn). When the predetermined amounts of Si and Mn are contained in the ground electrode 27, an oxide film can be formed on the surface of the ground electrode 27 so as to be strong and proof against deposit (adhesive substance such as oil and unburned fuel components).

The ground electrode 27 further contains carbon (C) in an amount of 0.1 mass % or less. When C is contained in the ground electrode 27, the ground electrode 27 can be increased in strength for improvement in deformation resistance. Alternatively, C may not be contained in the ground electrode 27.

Figure 3:
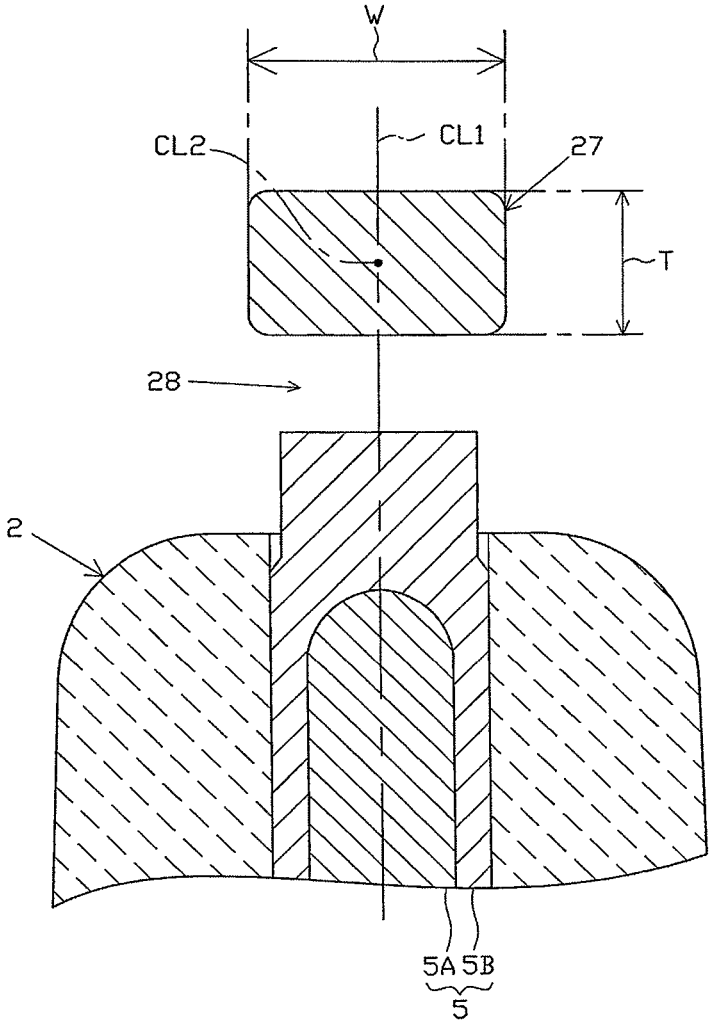
FIG. 3 is a cross-section view of a ground electrode, showing a thickness and width of the ground electrode, according to one embodiment of the present invention.

For diameter reduction of the metal shell 3, the radial width (wall thickness) of the front end face 26 of the metal shell 3 is made relatively small. The ground electrode 27, which is joined to the metal shell 3, is thus configured to have a relatively small thickness T (mm) (e.g. 0.7 to 1.4 mm) as shown in FIG. 3. As the thickness of the ground electrode 27 is made relatively small, the ground electrode 27 has a cross-sectional area of 2.0 $mm^2$ or smaller in any arbitrary cross section thereof taken in a direction perpendicular to a center line CL2 of the ground electrode 27 in the present embodiment. It is herein preferable that the cross-sectional area of the ground electrode 27 is 0.5 $mm^2$ or larger in order to secure the sufficient joint strength of the ground electrode 27 to the metal shell 3.

In the present embodiment, the ground electrode 27 is also configured to have a ratio L/S (1/mm) of 3 to 10 where S ($mm^2$) is a maximum cross-sectional area of the cross section of the ground electrode 27 taken in the direction perpendicular to the center line CL 2 of the ground electrode 27; and L (mm) is a length of the ground electrode 27 along the center line CL2 of the ground electrode 27.

The ground electrode 27 is further configured to have a ratio T/W of 0.6 to 1.0 where T (mm) is a thickness of the ground electrode 27 and W (mm) is a width of the ground electrode 27.

Moreover, the ground electrode 27 is configured to have a hardness of 130 to 260 Hv (preferably 150 to 240 Hv) at ordinary temperatures in terms of Vickers hardness. The hardness measurement is herein made on any part of the ground electrode 27 other than the part subjected to working after the joining of the ground electrode 27 to the metal shell 3 (i.e. the part where there occurs a change in hardness by working). As the ground electrode 27 is joined to the metal shell 3 and bent toward the center electrode 5 by plastic working as mentioned later, the hardness measurement is made on the part of the ground electrode 27 other than the bent portion 27B in the present embodiment.

For improvement in corrosion resistance, a zinc plating layer or Ni plating layer is applied to surfaces of the metal shell 3 and the ground electrode 27.

The above-structured spark plug 1 can be manufactured by the following method.

The metal shell 3 is first produced. More specifically, a semi-finished metal-shell member is produced by cold forging a cylindrical column-shaped metal material (such as iron-based material or stainless steel material) to form the metal material into a general shape and to make a though hole in the metal material, and then, cutting the outside shape of the metal material.

Figure 4A:
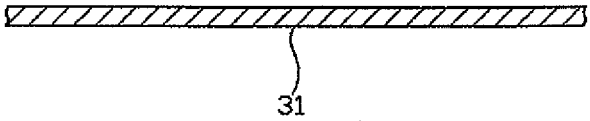
FIG. 4(*a*) is a cross-section view of a semi-processed member.
Figure 4B:
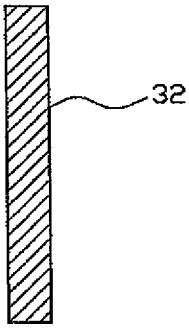

Subsequently, a metal member forming step is performed as follows in order to form a ground-electrode metal member 32 for the production of the ground electrode 27. A linear semi-processed member 31 containing 93 mass % or more of Ni is first prepared as shown in FIG. 4(*a*). Next, the semi-processed member 31 is subjected to heat treatment so as to decrease the hardness of the semi-processed member 31.

The semi-processed member 31 is then subjected to plastic working (such as rolling or wiredrawing) so as to shape the cross section of the semi-processed member 31, control the cross section of the semi-processed member 31 to 2.0 $mm^2$ or smaller and increase the hardness of the semi-processed member 31 to the above-mentioned hardness level (130 to 260 Hv). After that, the semi-processed member 31 is cut to a predetermined length and thereby completed as the ground-electrode metal member 32 as shown in FIG. 4(*b*).

The thus-obtained ground-electrode metal member 32 is joined by resistance welding to a front end face of the semi-finished metal-shell member. There occur burrs during the welding. After removing the welding burrs, the thread portion 15 is formed by thread rolling on a given area of the semi-finished metal-shell member. By this, the metal shell 3 is obtained, with the ground-electrode metal member 32 welded thereto.

The zinc plating layer or Ni plating layer is applied by a barrel plating machine (not shown) to the metal shell 3 to which the ground-electrode metal member 32 has been welded. For improvement in corrosion resistance, the metal shell 3 to which the ground-electrode metal member 32 has been welded may further be subjected to chromate surface treatment.

On the other hand, the ceramic insulator 2 is produced separately from the metal shell 3 and, more specifically, produced by preparing a granulated material from an alumina-based raw powder with a binder etc., rubber-pressing the prepared material into a cylindrical body, shaping by cutting the outside shape of the rubber-pressed body, and then, firing the resulting cylindrical body in a firing furnace.

Further, the center electrode 5 is produced separately from the metal shell 3 and the ceramic insulator 2 by forging an alloy material in which a copper alloy for improvement in thermal radiation performance is placed in the center of a Ni alloy.

The ceramic insulator 2, the center electrode 5, the resistive element 7 and the terminal electrode 6 are fixed together by the glass seal layers 8 and 9. In general, a material of the glass seal layer 8, 9 is prepared by mixing a borosilicate glass with a metal powder. The prepared material is filled into the axial hole 4 of the ceramic insulator 2 in such a manner as to sandwich therebetween the resistive element 7. The filled material is solidified by firing in a firing furnace, with the terminal electrode 6 pressed into the filled material from the rear. At this time, a glazing layer may be formed simultaneously, or in advance, on a surface of the rear body portion 10 of the ceramic insulator 2.

The ceramic insulator 2 with the center electrode 5 and the terminal electrode 6 is fixed in the metal shell 3 to which the ground-electrode metal member 32 has been welded. More specifically, the ceramic insulator 2 and the metal shell 3 are fixed together by inserting the ceramic insulator 2 in the metal shell 3 and crimping the relatively thin open rear end of the metal shell 3 radially inwardly i.e. forming the crimped portion 20.

Finally, the ground electrode 27 is bent at the substantially middle portion thereof toward the center electrode 5, thereby forming the bent portion 27B on the ground electrode 27 and adjusting the spark discharge gap 28 between the center electrode 5 and the ground electrode 27. In this way, the above-mentioned spark plug 1 is completed.

As described in detail above, the hardness of the ground electrode 27 is controlled to 130 Hv or higher so as to, even when the cross-sectional area of the ground electrode 27 is 2.0 $mm^2$ or smaller, provide the ground electrode 27 with sufficient mechanical strength in the present embodiment. It is therefore possible to maintain the sufficient deformation resistance of the ground electrode 27.

In the present embodiment, the hardness of the ground electrode 27 is also controlled to 260 Hv or lower so as to prevent distortion of metal crystal grains in the ground electrode 27. The ground electrode 27 can thus obtain improvement in thermal conductivity. When the ground electrode 27 is made of the metal material containing 93 mass % or more of high thermal conductivity Ni, the ground electrode 27 can obtain further improvement in thermal conductivity. In other words, the thermal conductivity of the ground electrode 27 can be increased dramatically by making the ground electrode 27 of the metal material containing 93 mass % or more of Ni while controlling the hardness of the ground electrode 27 to 260 Hv or lower. It is therefore possible to attain the high wear resistance of the ground electrode 27 even when the ground electrode 27 is formed with a cross-sectional area of 2.0 $mm^2$ or smaller and particularly concerned about deterioration in wear resistance.

Further, the ratio of the length L of the ground electrode 27 to the maximum cross-sectional area S of the ground electrode 27 is controlled to 3 (1/mm) or larger so that the length L of the ground electrode 27 is made sufficiently large. This makes it possible to more assuredly define the spark discharge gap 28 between the distal end portion of the ground electrode 27 and the center electrode 5. The ratio L/S is also controlled to 10 (1/mm) or smaller so that the length L of the ground electrode 27 does not become excessively large in the prevent embodiment. This allows reduction of stress on the ground electrode 27 during plating process etc. and thereby makes it possible to improve the deformation resistance of the ground electrode 27 to a higher level.

In the present embodiment, the thickness T of the ground electrode 27 is made 0.6 times or larger than the width W of the ground electrode 27 so as not to become excessively small. It is thus possible that the ground electrode 27 can attain sufficient strength against load applied in its thickness direction and more assuredly prevented from bending deformation more assuredly.

Furthermore, one or more kinds of rare earth elements are contained in the ground electrode 27 in a total amount of 0.05 mass % or more in the present embodiment. It is thus possible to assuredly prevent the growth of metal grains in the ground electrode 27 and improve the wear resistance of the ground electrode 27 to a higher level. As the growth of metal grains in the ground electrode 27 can be prevented, it is possible to assuredly protect the ground electrode 27 from breakage even in the case where the ground electrode 27 is subjected to vibrations under high-temperature conditions. It is further possible to effectively avoid the occurrence of a grain sweating phenomenon and assuredly prevent deterioration in ignition performance by controlling the total content amount of the rare earth elements to a sufficiently small level of 0.45 mass % or less.

In the present embodiment, the ground-electrode metal member 32 of predetermined hardness is formed by once softening the semi-processed member 31 by heat treatment and then hardening the semi-processed member 31 by plastic working. This makes it easier to control the hardness of the ground-electrode metal member 32 in comparison to the case of controlling the hardness of the ground-electrode metal member to the predetermined level only by heat treatment. It is thus possible to easily obtain the ground-electrode metal member 32 of predetermined hardness for improvement in productivity.

In order to verify the functions and effects of the above-mentioned embodiment, a plurality of spark plug samples with ground electrodes were prepared by, while making the ground electrode constant in cross section along its longitudinal direction, varying the hardness and cross-sectional area S ($mm^2$) of the ground electrode, the ratio (L/S) of the length L (mm) of the ground electrode to the maximum cross-sectional area ($mm^2$; equal to the cross-sectional area S) of the ground electrode and the ratio (T/W) of the thickness T of the ground electrode to the width W (mm) of the ground electrode. These samples were tested by wear resistance evaluation test. The wear resistance evaluation test was herein performed by the following procedure. First, each of the samples was mounted on a 4000-cc six-cylinder gasoline engine. The engine was then driven at full throttle at an engine rotation speed of 3000 rpm for 300 hours by the use of lead-free gasoline as engine fuel. After the lapse of 300 hours, the size of the spark discharge gap was measured to determine the amount of increase of the spark discharge gap (referred to as "gap increase") relative to that before the test (initial state). The sample was evaluated as having very good wear resistance and marked with "*" when the gap increase of the sample was 0.10 mm or smaller. The sample was evaluated as having good wear resistance and marked with "◎" when the gap increase of the sample was larger than 0.10 mm and smaller than or equal to 0.15 mm. The sample was evaluated as having satisfactory wear resistance and marked with "○" when the gap increase of the sample was larger than 0.15 mm and smaller than or equal to 0.20 mm. On the other hand, the sample was evaluated as being insufficient in wear resistance and marked with "×" when the gap increase of the sample was larger than 0.20 mm A plurality of samples of the ground electrodes were further prepared by varying the hardness, the cross-sectional area and the ratios L/S and T/V of the ground electrode sample. These samples were tested by deformation resistance evaluation test. The deformation resistance evaluation test was herein performed by the following procedure. Each type of the samples was supplied to a spark plug manufacturing line and subjected to the processes of joining the ground electrode to a metal shell and applying a plating layer to the ground electrode by a barrel plating machine. The number of ground electrode samples in which a bend or twist occurred after these manufacturing processes was measured to determine the rate of occurrence of the bend or twist (referred to as "failure rate"). The sample was evaluated as having very good deformation resistance and marked with "☆" when the failure rate of the sample was 1.0% or lower. The sample was evaluated as having good deformation resistance and marked with "◎" when the failure rate of the sample was higher than 1.0% and lower than or equal to 2.0%. The sample was evaluated as having satisfactory deformation resistance and marked with "○" when the failure rate of the sample was higher than 2.0% and lower than or equal to 3.0%. On the other hand, the sample was evaluated as being insufficient in deformation resistance and marked with "×" when the failure rate of the sample was higher than 3.0%.

The test results of the wear resistance evaluation test and deformation resistance evaluation test are indicated in TABLE 1. In the above tests, the ground electrode was made of an alloy containing 93 mass % or more of Ni and capable of, when sufficiently subjected to heat treatment (annealing treatment), showing a hardness of 100 Hv; and the hardness of the ground electrode was controlled by adjusting the conditions of plastic working.

In each sample, the thread diameter size of the thread portion was set to M14; the protrusion length of the front end portion of the ceramic insulator from the front end of the metal shell was set to 3 mm; and the protrusion length of the front end portion of the center electrode from the front end of the ceramic insulator was set to 3 mm. Further, the size of the spark discharge gap before the test was set to 0.8 mm; and the outer diameter of the front end portion of the center electrode was set to 2.5 mm. In the after-mentioned wear resistance evaluation test and deformation resistance test, the sizes of samples such as the thread diameter size of the threaded portion were the same as above.

TABLE 1

| No. | Cross-sectional area S of ground electrode ($mm^2$) | Hardness (Hv) | L/S (1/mm) | T/W |
|---|---|---|---|---|
| 1 | 2.2 | 120 | 6 | 0.8 |
| 2 | 2.2 | 270 | 6 | 0.8 |
| 3 | 2.5 | 120 | 6 | 0.8 |
| 4 | 2.5 | 270 | 6 | 0.8 |
| 5 | 1.5 | 270 | 6 | 0.8 |
| 6 | 2.0 | 270 | 6 | 0.8 |
| 7 | 1.5 | 120 | 6 | 0.8 |
| 8 | 2.0 | 120 | 6 | 0.8 |
| 9 | 1.5 | 130 | 6 | 0.8 |
| 10 | 1.5 | 150 | 6 | 0.8 |
| 11 | 1.5 | 180 | 6 | 0.8 |
| 12 | 1.5 | 220 | 6 | 0.8 |
| 13 | 1.5 | 240 | 6 | 0.8 |
| 14 | 1.5 | 260 | 6 | 0.8 |
| 15 | 2.0 | 130 | 6 | 0.8 |
| 16 | 2.0 | 150 | 6 | 0.8 |
| 17 | 2.0 | 180 | 6 | 0.8 |
| 18 | 2.0 | 220 | 6 | 0.8 |
| 19 | 2.0 | 240 | 6 | 0.8 |
| 20 | 2.0 | 260 | 6 | 0.8 |
| 21 | 1.5 | 150 | 3 | 0.8 |
| 22 | 1.5 | 150 | 10 | 0.8 |
| 23 | 1.5 | 150 | 11 | 0.8 |
| 24 | 1.5 | 150 | 6 | 0.5 |
| 25 | 1.5 | 150 | 6 | 0.6 |
| 26 | 1.5 | 150 | 6 | 1.0 |
| 27 | 2.0 | 150 | 3 | 0.8 |
| 28 | 2.0 | 150 | 10 | 0.8 |
| 29 | 2.0 | 150 | 11 | 0.8 |
| 30 | 2.0 | 150 | 6 | 0.5 |
| 31 | 2.0 | 150 | 6 | 0.6 |
| 32 | 2.0 | 150 | 6 | 1.0 |

TABLE 1-continued

| | Wear resistance evaluation test | | Deformation resistance evaluation test | |
|---|---|---|---|---|
| No. | Gap increase (mm) | Evaluation | Failure rate (%) | Evaluation |
| 1 | 0.05 | ☆ | 2.8 | ○ |
| 2 | 0.20 | ○ | 0.5 | ☆ |
| 3 | 0.03 | ☆ | 2.0 | ◎ |
| 4 | 0.14 | ◎ | 0.4 | ☆ |
| 5 | 0.22 | X | 0.5 | ☆ |
| 6 | 0.21 | X | 0.5 | ☆ |
| 7 | 0.06 | ☆ | 3.3 | X |
| 8 | 0.05 | ☆ | 3.1 | X |
| 9 | 0.07 | ☆ | 2.5 | ○ |
| 10 | 0.08 | ☆ | 1.8 | ◎ |
| 11 | 0.10 | ☆ | 1.4 | ◎ |
| 12 | 0.13 | ◎ | 1.1 | ◎ |
| 13 | 0.15 | ◎ | 0.8 | ☆ |
| 14 | 0.20 | ○ | 0.6 | ☆ |
| 15 | 0.06 | ☆ | 2.3 | ○ |
| 16 | 0.07 | ☆ | 1.6 | ◎ |
| 17 | 0.09 | ☆ | 1.3 | ◎ |
| 18 | 0.12 | ◎ | 1.0 | ☆ |
| 19 | 0.14 | ◎ | 0.7 | ☆ |
| 20 | 0.18 | ○ | 0.6 | ☆ |
| 21 | 0.07 | ☆ | 1.4 | ◎ |
| 22 | 0.07 | ☆ | 2.0 | ◎ |
| 23 | 0.07 | ☆ | 2.1 | ○ |
| 24 | 0.07 | ☆ | 2.1 | ○ |
| 25 | 0.07 | ☆ | 2.0 | ◎ |
| 26 | 0.07 | ☆ | 1.6 | ◎ |
| 27 | 0.07 | ☆ | 1.3 | ◎ |
| 28 | 0.07 | ☆ | 1.9 | ◎ |
| 29 | 0.07 | ☆ | 2.1 | ○ |
| 30 | 0.07 | ☆ | 2.1 | ○ |
| 31 | 0.07 | ☆ | 1.9 | ◎ |
| 32 | 0.07 | ☆ | 1.5 | ◎ |

As clearly indicated in TABLE 1, the samples (Sample Nos. 1 to 4) in which the cross-sectional area of the ground electrode was 2.5 $mm^2$ or 2.2 $mm^2$ had good wear resistance and deformation resistance regardless of the hardness of the ground electrode. By contrast, there was a possibility that the samples in which the cross-sectional area of the ground electrode was 2.0 $mm^2$ or smaller could not attain sufficient performance in terms of wear resistance and deformation resistance. The reason for this is assumed to be that the mechanical strength and thermal conductivity of the ground electrode decreased with the thickness of the ground electrode.

The samples (Sample Nos. 9 to 32) in which the hardness of the ground electrode was 130 to 260 Hv had sufficient performance in terms of both wear resistance and deformation resistance even when the cross-sectional area of the ground electrode 2.0 $mm^2$ or smaller. The reason for this is assumed to be that: it was possible to improve the mechanical strength of the ground electrode by controlling the hardness of the ground electrode to 130 Hv or higher and possible to prevent the occurrence of distortion of metal crystal grains in the ground electrode and allow efficient conduction of heat from the front end to the rear end of the ground electrode (i.e. toward the metal shell) by controlling the hardness of the ground electrode to 260 Hv or lower.

In particular, the samples (Sample Nos. 10 to 13, 16 to 19 and 21 to 32) in which the hardness of the ground electrode was 150 to 240 Hv had good performance in terms of both wear resistance and deformation resistance.

As seen from the test results of the samples (Sample Nos. 21 to 23 and 27 to 29) that were the same in hardness, cross-sectional area S and ratio T/W, but different in ratio L/S, it was possible to effectively improve the deformation resistance of the ground electrode by controlling the ratio L/S to 10 or smaller. The reason for this is assumed to be that the stress applied to the ground electrode during the plating process etc. was reduced as the length L was controlled in such a manner that the length L did not become excessively large.

It was possible to make some contribution to the improved deformation resistance of the ground electrode by controlling the ratio T/W to 0.6 or larger as seen from the test results of the samples (Sample Nos. 24 to 26 and 30 to 32) that were the same in hardness, cross-sectional area S and ratio L/S but different in ratio T/W. The reason for this is assumed to be that the ground electrode had sufficient strength to the load in the thickness direction as the ratio T/W was controlled to 0.6 or larger.

Next, a plurality of ground electrodes were prepared by controlling the Ni content of the ground electrode to 90 mass % or 93 mass % and varying the hardness of the ground electrode. Each of the ground electrodes was tested by the same deformation resistance evaluation test as above. Spark plug samples were prepared using these ground electrodes and tested by the same wear resistance evaluation test as above. The test results of the evaluation tests are indicated in TABLE 2. Herein, the ground electrode was made of an alloy containing not only Ni but also at least one kind of Si, Cr, Al, Mn, C, Ti, Mg, Fe, Cu, P and S. The total content of Si, Cr etc. in each sample is also indicated in TABLE 2. Further, the ratio L/S was set to 6; and the ratio T/W was set to 0.8 in each sample of the evaluation tests.

TABLE 2

| No. | Cross-sectional area of ground electrode ($mm^2$) | Hardness (Hv) | Ni content (mass %) | Total content of Si, Cr etc. (mass %) |
|---|---|---|---|---|
| 41 | 1.5 | 270 | 93 | 7 |
| 42 | 1.5 | 120 | 93 | 7 |
| 43 | 1.5 | 240 | 90 | 10 |
| 44 | 1.5 | 130 | 93 | 7 |
| 45 | 1.5 | 150 | 93 | 7 |
| 46 | 1.5 | 180 | 93 | 7 |
| 47 | 1.5 | 220 | 93 | 7 |
| 48 | 1.5 | 240 | 93 | 7 |
| 49 | 1.5 | 260 | 93 | 7 |

| | Wear resistance evaluation test | | Deformation resistance evaluation test | |
|---|---|---|---|---|
| No. | Gap increase (mm) | Evaluation | Failure rate (%) | Evaluation |
| 41 | 0.22 | X | 0.4 | ☆ |
| 42 | 0.06 | ☆ | 3.1 | X |
| 43 | 0.21 | X | 0.5 | ☆ |
| 44 | 0.07 | ☆ | 2.4 | ○ |
| 45 | 0.08 | ☆ | 1.8 | ◎ |
| 46 | 0.10 | ☆ | 1.2 | ◎ |
| 47 | 0.13 | ◎ | 0.9 | ☆ |
| 48 | 0.15 | ◎ | 0.7 | ☆ |
| 49 | 0.20 | ○ | 0.5 | ☆ |

As indicated in TABLE 2, the sample (Sample No. 43) in which the Ni content of the ground electrode was less than 93 mass % had poor wear resistance even if the hardness of the ground electrode was controlled to 130 to 260 Hv. The reason for this is assumed to be that the ground electrode was low in thermal conductivity due to its relatively low Ni content.

By contrast, the samples (Sample Nos. 44 to 49) in which the ground electrode was formed with a hardness of 130 to 260 Hv and a Ni content of 93 mass % or more had sufficient performance in terms of both wear resistance and deformation resistance.

It has been shown by the above test results that it is preferable to control the Ni content of the ground electrode to 93 mass % and control the hardness of the ground electrode to 130 to 260 Hv in order to attain sufficient performance in terms of both wear resistance and deformation resistance in the spark plug where the ground electrode is formed with a cross-sectional area of 2.0 $mm^2$ or smaller and concerned about deterioration in wear resistance and deformation resistance. It is said that it is more preferable to control the hardness of the ground electrode to 150 to 240 Hv for further improvements in wear resistance and deformation resistance.

It is also said that it is more preferable to control the ratio L/S to 10 or lower and control the ratio T/W to 0.6 or higher for further improvement in deformation resistance.

Further, a plurality of ground electrodes were prepared by adding one or more kinds of rare earth elements (including at least Y) into the ground electrode and varying the total content of the rare earth elements. Each of the ground electrodes was tested by the same deformation resistance evaluation test as above. Spark plug samples were prepared using these ground electrodes and tested by the same wear resistance evaluation test as above. Each of the spark plug samples was also tested by sweating resistance evaluation test and breaking resistance evaluation test.

The sweating resistance evaluation test was herein performed by the following procedure. First, each of the samples was mounted on a 2000-cc six-cylinder gasoline engine. The engine was then driven at full throttle at an engine rotation speed of 5000 rpm for 100 hours by the use of lead-free gasoline as engine fuel. After the lapse of 100 hours, the surface of the ground electrode was observed. When the surface of the ground electrode had a grain sweating phenomenon (oxide grain formation), the sweating resistance of the sample was marked with "×" upon judging that the sample had a possibility of deterioration in ignition performance or the like under the influence of such a grain sweating phenomenon. When the surface of the ground electrode did not have a sweating phenomenon but was in a rough state (where oxide projections were formed on the surface of the ground electrode), the sweating resistance of the sample was marked with "Δ" upon judging that: the appearance of the sample was unfavorable; and the sample had a possibility of adverse effect on ignition performance or the like during use.

On the other hand, the sample was evaluated as being good in terms of appearance, ignition performance and the like and marked with "○" when there was no sweating phenomenon and no rough state on the surface of the ground electrode.

The breaking resistance evaluation test was performed as follows. Each of the samples was subjected to vibrations at a frequency of 40 Hz and at an acceleration of 30 G for 8 hours while heating and maintaining the ground electrode at 1000° C. After the lapse of 8 hours, the occurrence of breakage in the ground electrode was checked. The sample was evaluated as being inferior in breaking resistance and marked with "×" when breakage occurred in the ground electrode. The sample was evaluated as being rather poor in breaking resistance and marked with "Δ" when there occurred no breakage but cracking in the ground electrode.

The sample was evaluated as having good breaking resistance and marked with "○" where there was no breakage and no cracking in the ground electrode.

The test results of the wear resistance evaluation test, deformation resistance evaluation test, sweating resistance evaluation test and breaking resistance evaluation test are indicated in TABLE 3. In each of these evaluation tests, the cross-sectional area of the ground electrode was set to 1.5 $mm^2$; and the hardness of the ground electrode was set to 180 Hv. In each of the samples of the sweating resistance evaluation test and breaking resistance evaluation test, the thread diameter size of the thread portion was set to M12; the protrusion length of the front end portion of the ceramic insulator from the front end of the metal shell was set to 3 mm; and the protrusion length of the front end portion of the center electrode from the front end of the ceramic insulator was set to 3 mm. The size of the spark discharge gap before the test was set to 0.8 mm; and the outer diameter of the front end portion of the center electrode was set to 2.5 mm. Further, the ratio L/S was set to 6; and the ratio T/W was set to 0.8 in each sample.

TABLE 3

| | Ni | Total rare earth element | Total content of | Wear resistance evaluation test | |
|---|---|---|---|---|---|
| No. | content (mass %) | content (mass %) | Si, Cr etc. (mass %) | Gap increase (mm) | Evaluation |
| 51 | 97 | 0.03 | 2.97 | 0.10 | ☆ |
| 52 | 97 | 0.05 | 2.95 | 0.09 | ☆ |
| 53 | 97 | 0.25 | 2.75 | 0.09 | ☆ |
| 54 | 97 | 0.45 | 2.55 | 0.09 | ☆ |
| 55 | 97 | 0.60 | 2.40 | 0.10 | ☆ |

| | Deformation resistance evaluation test | | Sweating resistance | Breaking resistance |
|---|---|---|---|---|
| No. | Failure rate (%) | Evaluation | evaluation | evaluation |
| 51 | 1.8 | ◎ | ○ | Δ |
| 52 | 1.6 | ◎ | ○ | ○ |
| 53 | 1.7 | ◎ | ○ | ○ |
| 54 | 1.7 | ◎ | ○ | ○ |
| 55 | 1.6 | ◎ | Δ | ○ |

As indicated in TABLE 3, the samples (Sample Nos. 52 to 54) in which the total rare earth element content was 0.05 to 0.45 mass % had both good sweating resistance and good breaking resistance.

It has thus been shown by the above test results that it is preferable to not only add at least one or more kinds of rare earth elements into the ground electrode but also to control the total rare earth element content of the ground electrode to 0.05 to 0.45 mass % for improvements in sweating resistance and breaking resistance.

The present invention is not limited to the above-mentioned embodiment and may be embodied as follows. It is needless to say that any application and modification examples other than those indicated below are possible.

Figure 5A:
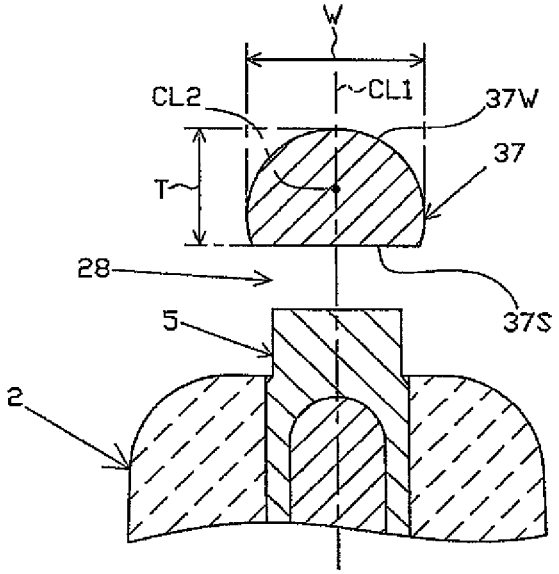
FIGS. 5(*a*) and (*b*) are enlarged cross-section views of parts of ground electrodes, showing cross-sectional configurations of the respective ground electrodes, according to other embodiments of the present invention.
Figure 5B:
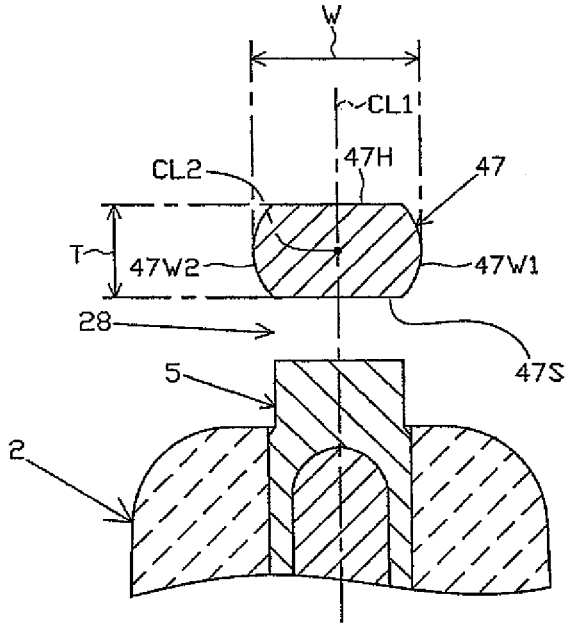

(a) In the above embodiment, the ground electrode 27 is rectangular in cross section. It is alternatively feasible to provide a ground electrode 37 that has a flat surface 37S facing the center electrode 5 and a convex curved back surface 37W located opposite the flat surface 37 as shown in FIG. 5(*a*), or to provide a ground electrode 47 that has a flat surface 47S facing the center electrode 5, a flat back surface 47H located opposite the flat surface 47S and opposite, convex curved side surfaces 47W1 and 47W2 extending between the flat surface 47S and the back surface 47H as shown in FIG. 5(*b*). In either case, it is easier that the fuel gas will flow into the spark discharge gap 28 around the ground electrode 37, 47 for improvement in ignition performance. In contrast to the rectangular cross-section ground electrode 27, the ground electrode 37, 47 has an outer circumference formed with edges of relatively large angle and causes more deterioration in mechanical strength. There is thus a greater possibility that the ground electrode 37, 47 may be bent or twisted during manufacturing. It is however possible by the adoption of the present invention to effectively prevent the ground electrode from bending deformation or the like. Namely, the present invention is particularly effective in the case where the ground electrode has a curved surface on its outer circumference.

(b) Although the spark discharge gap 28 is defined between the front end portion of the center electrode 5 and the distal end portion of the ground electrode 27 in the above embodiment, it is alternatively feasible to fix a noble metal tip of noble metal alloy (e.g. platinum alloy or iridium alloy) to either one or both of these electrodes 5 and 27 and thereby define the spark discharge gap 28 between the noble metal tip on the one electrode 5 (27) and the other electrode 27 (5) or between the noble metal tips on the respective electrodes 5 and 27. In the case of fixing the noble metal tip to the ground electrode 27, the hardness of the ground electrode 27 is measured at any part other than that where there occurs a change in hardness due to the joining of the noble metal chip (e.g. at a position of 1.5 mm or more apart from a lateral surface of the noble metal tip).

(c) In the above embodiment, the ground-electrode metal member 32 is formed as the material for production of the ground electrode 27 by subjecting the semi-processed member 31 to plastic working (such as rolling or wiredrawing) and thereby increasing the hardness of the semi-processed member 31. It is alternatively feasible to form the ground-electrode metal member 32 by heat treating the semi-processed member 31 and thereby decreasing the hardness of the semi-processed member 31. More specifically, the ground-electrode metal member 32 can be formed with a hardness of 130 to 260 Hv by, after subjecting the semi-processed member 31 to plastic working (e.g. wiredrawing) so as to increase the hardness of the semi-processed member 31 to be 130 Hv or higher and control the cross-sectional area of the semi-processed member 31 to a sufficiently small level of 2.0 $mm^2$ or smaller, subjecting the semi-processed member 31 to heat treatment (e.g. annealing) so as to decrease the hardness of the semi-processed member 31, and then, cutting the semi-processed member 31 to a given length. It is herein necessary to adjust the heating time and heating temperature during the heat treatment in such a manner that the hardness of the semi-processed member 31 does not become excessively low. The heat treatment may be conducted after the cutting of the semi-processed member 31.

(d) Although the tool engagement portion 19 is hexagonal in cross section in the above embodiment, the shape of the tool engagement portion 19 is not limited to such a hexagonal cross-section shape. The tool engagement portion 19 may alternatively be formed into a Bi-HEX shape (modified dodecagonal shape) (according to ISO 22977: 2005(E)) or the like.

DESCRIPTION OF REFERENCE NUMERALS

1: Spark plug
2: Insulator (Ceramic insulator)
3: Metal shell

4: Axial hole
5: Center electrode
27: Ground electrode
28: Spark discharge gap (gap)
31: Semi-processed member
32: Ground-electrode metal material
37W, 47W1, 47W2: Curved surface
CL1: Axis
CL2 Center line (of ground electrode)

The invention claimed is:

1. A spark plug, comprising:

a cylindrical insulator having an axial hole formed therethrough in an axis direction of the spark plug;

a center electrode inserted in a front side of the axial hole;

a cylindrical metal shell disposed around the insulator; and a ground electrode joined to a front end portion of the metal shell in such a manner as to define a gap between the center electrode and the ground electrode, wherein the ground electrode alone:

is made of a metal material containing 97 mass % or more of nickel;

has a cross-sectional area of 2.0 $mm^2$ or smaller in any arbitrary cross section thereof taken in a direction perpendicular to a center line of the ground electrode;

has a hardness of 130 to 260 Hv in terms of Vickers hardness; and has a ratio T/W of 0.6 or larger where T (mm) is a thickness of the ground electrode and W (mm) is a width of the ground electrode.

2. The spark plug according to claim 1, wherein the ground electrode has a hardness of 150 to 240 Hv in terms of Vickers hardness.

3. The spark plug according to claim 1, wherein the ground electrode has a ratio L/S (1/mm) of 3 to 10 where S ($mm^2$) is a maximum cross-sectional area of the cross section of the ground electrode taken perpendicular to the center line of the ground electrode and L (mm) is a length of the ground electrode along the center line of the ground electrode.

4. The spark plug according to claim 1, wherein the ground electrode has a flat surface facing the center electrode and a convex curved back surface located opposite the flat surface.

5. The spark plug according to claim 1, wherein the ground electrode has a flat surface facing the center electrode, a flat back surface located opposite the flat surface and opposite, convex curved side surfaces extending between the flat surface and back surface of the ground electrode.

6. The spark plug according to claim 1, wherein the metal material of the ground electrode contains one or more kinds of rare earth elements in a total amount of 0.05 to 0.45 mass %.

7. The spark plug according to claim 1, wherein the at least part of a surface of the ground electrode is covered with a plating layer.

8. A method for manufacturing a ground-electrode metal member for the production of a ground electrode for a spark plug, comprising:

a softening step of allowing a semi-processed member of metal material containing 97 mass % or more of nickel to undergo heat treatment so as to decrease the hardness of the semi-processed member; and a hardening step of, after the softening step, subjecting the semi-processed member to plastic working so as to increase the hardness of the semi-processed member and thereby complete the semi-processed member as the ground-electrode metal member, wherein the ground-electrode metal member has a ratio T/W of 0.6 or larger where T (mm) is a thickness of the ground-electrode metal member and W (mm) is a width of the ground electrode-metal member.

* * * * *